United States Patent [19]

Hyre

[11] 4,123,031

[45] Oct. 31, 1978

[54] CONCRETE ROADWAY-SLAB FORMING AND FORM-ELEVATION ADJUSTING MEANS

[76] Inventor: Robert W. Hyre, P.O. Box 7082, Chattanooga, Tenn. 37410

[21] Appl. No.: 802,564

[22] Filed: Jun. 1, 1977

Related U.S. Application Data

[63] Continuation-in-part of Ser. No. 723,136, Sep. 14, 1976, abandoned.

[51] Int. Cl.[2] ..... E01D 1/00

[52] U.S. Cl. ..... 249/24; 14/1; 249/25; 249/211

[58] Field of Search ..... 249/19, 23–25, 249/211; 14/1; 248/354 P, 354 S, 357; 52/632

[56] References Cited

U.S. PATENT DOCUMENTS

| | | | |
|---|---|---|---|
| 2,725,210 | 11/1955 | Swartz | 248/354 P |
| 3,628,765 | 12/1971 | Sanders | 249/24 |
| 3,960,357 | 6/1976 | Honea, Jr. | 249/24 |

FOREIGN PATENT DOCUMENTS

| | | | |
|---|---|---|---|
| 343,114 | 1/1960 | Switzerland | 249/23 |
| 321,612 | 2/1972 | U.S.S.R. | 249/25 |

*Primary Examiner*—Francis S. Husar
*Assistant Examiner*—John McQuade
*Attorney, Agent, or Firm*—J. Harold Kilcoyne

[57] ABSTRACT

Concrete-slab forming means and more particularly improvements in means for supporting and adjusting the elevation of the forms for concrete roadway slabs which bridge the space between spaced-apart pairs of in-place girders. The forming means per se comprises a preferably plywood deck or decking disposed at a predetermined elevation and which extends between the girder pairs and is laid directly on joists in turn supported on purlins, (preferably "split" or spaced-apart purlins), extending between said girders. The supporting means therefor which also must support the concrete deck load comprises a plurality of form supporting assemblies disposed at predetermined spacings from one another along the length of the girders of the pairs thereof, and which are so constructed as to be capable, by extending substantially vertically between the foot flanges of each two parallel girders and the ends of the purlins, of supporting and adjusting the elevation of said purlins, joists, plywood deck and thereby of the concrete deck load.

7 Claims, 4 Drawing Figures

CONCRETE ROADWAY-SLAB FORMING AND FORM-ELEVATION ADJUSTING MEANS

HISTORY

The present application is a continuation-in-part of my prior application Ser. No. 723,136 filed Sept. 14, 1976 (now abandoned).

INTRODUCTION

The invention herein disclosed relates generally to concrete bridge-slab forming and form supporting means, and more particularly to an improved, simplified yet highly effective means for forming and for supporting and adjusting the elevation of the forms on which concrete roadway slabs are successively laid between spaced pairs of precast in-place concrete (or I-beam type) girders.

THE INVENTION—GENERAL

To overcome the difficulties heretofore encountered in forming and supporting the forms for concrete bridge slabs which when laid and hardened (cured) extend roadway-fashion between and are supported on pairs of precast in-place concrete (or steel I-beam type) girders, which difficulties stem in large measure from variables in girder shapes, different spacing between girder pairs, inability in adjusting the elevation of the decking on which the concrete is to be poured from the upper side of the decking, etc., the invention provides an adjustable concrete -slab forming and form supporting system comprising, for each girder pair and disposed at predetermined spacings from one another along the length of parallel girders, pairs of vertically adjustable form-supporting members whose lower ends incorporate brackets shaped to the oppositely sloped (or horizontally extending in the case of I-beam type girders) foot flanges of parallel girders and which mount at their upper ends upwardly opening U-members for the reception and securement of the ends of purlins, preferably "split," i.e., spaced-apart purlins, disposed on edge and which extend substantially the distance between the girders of the pairs thereof and on which are positioned a plurality of laterally spaced 4×4 or 4×6 wood joists on which the plywood deck is placed and secured as by nailing. To insure that said vertically adjustable form-supporting members and particularly said brackets mounted at the lower ends thereof, are maintained in pressed-tight engagement against said facing girder flanges, the invention also provides adjustable-length cross members extending between and connected at their opposite ends to vertically adjustable form-supporting members of the pairs thereof, and preferably at locations along the length of said vertical members such that upon their proper length adjustment, they exert force on said brackets in direction as to securely hold same in place against the girder foot flanges.

A particularly noteworthy feature of my herein invention resides in the means incorporated therein for enabling first an approximate adjustment of the elevation of the plywood decking from below same (by means which is more or less conventional) and thereafter, i.e., after the slab-reinforcing steel has been placed and just prior to pouring of the concrete thereon, a final adjustment of the decking (raising or lowering) to an exact predetermined elevation by means operable from above, i.e., from the upper side of, the plywood decking.

OBJECTS OF THE INVENTION

From the foregoing, it becomes apparent that the invention has for its principal object that of simplifying and reducing the time and costs previously involved in concrete bridge construction, by providing improved and simplified forming means and for supporting the forms on which the concrete roadway slabs which extend between in-place girders are laid.

A further object of the invention is the provision of concrete bridge-slab forming means and means for supporting the forms on which concrete bridge slabs are laid between parallelly disposed girders, which means can be readily conformed to different shapes of girders, different spacings between girders, etc., etc.

Yet another important object of my present invention is the provision of simple yet effective means enabling an approximate adjustment of the elevation of the plywood decking on which the concrete slab is to be laid from below the decking as is more or less conventional and thereafter and just prior to the pouring of the concrete, a final adjustment of said decking to an exact predetermined final elevation, the latter adjustment being made from above the plywood decking.

Other objects will become apparent from the following more detailed description of the invention, taken with the accompanying illustrative drawing figures, wherein.

Figure 1:
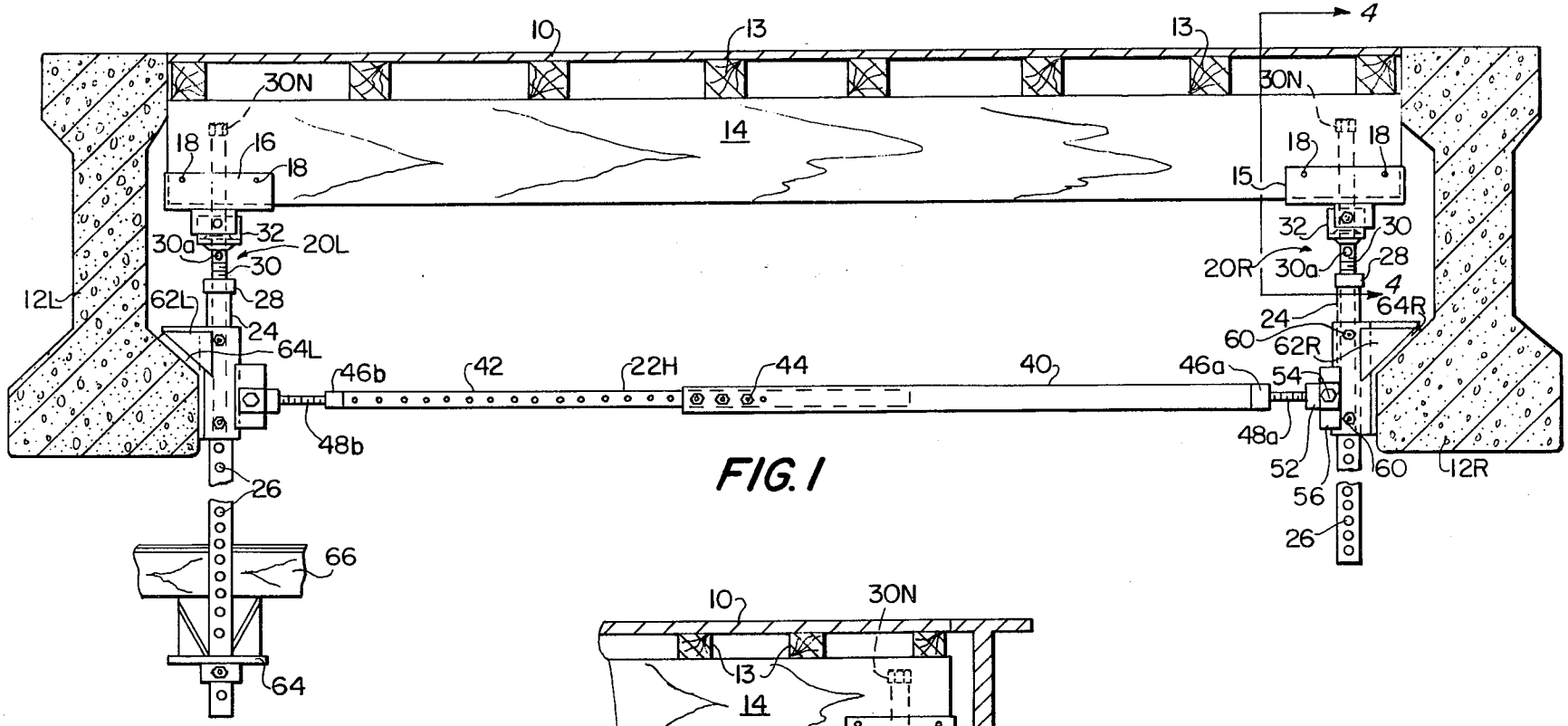
FIG. 1 is a view in side elevation, partly in section, of one embodiment of concrete roadway slab form and form-supporting means shown as extending between two precast in-place concrete girders, according to the invention.
Figure 2:
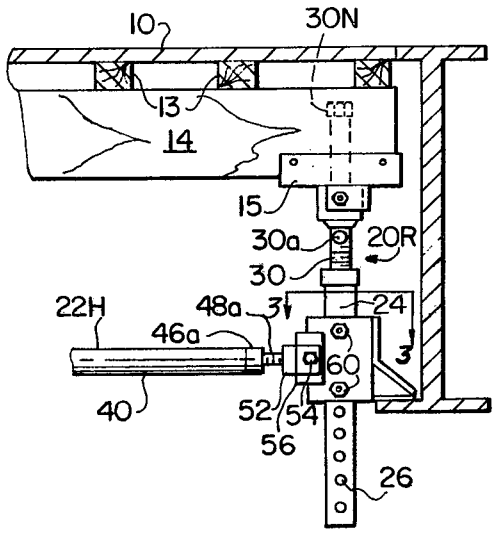
FIG. 2 is a fragmentary view illustrating the capability of concrete slab forming means of the invention being supported from the foot flanges of steel I-beam type girders rather than from the inclined foot flanges of the more conventional concrete girders.
Figure 4:
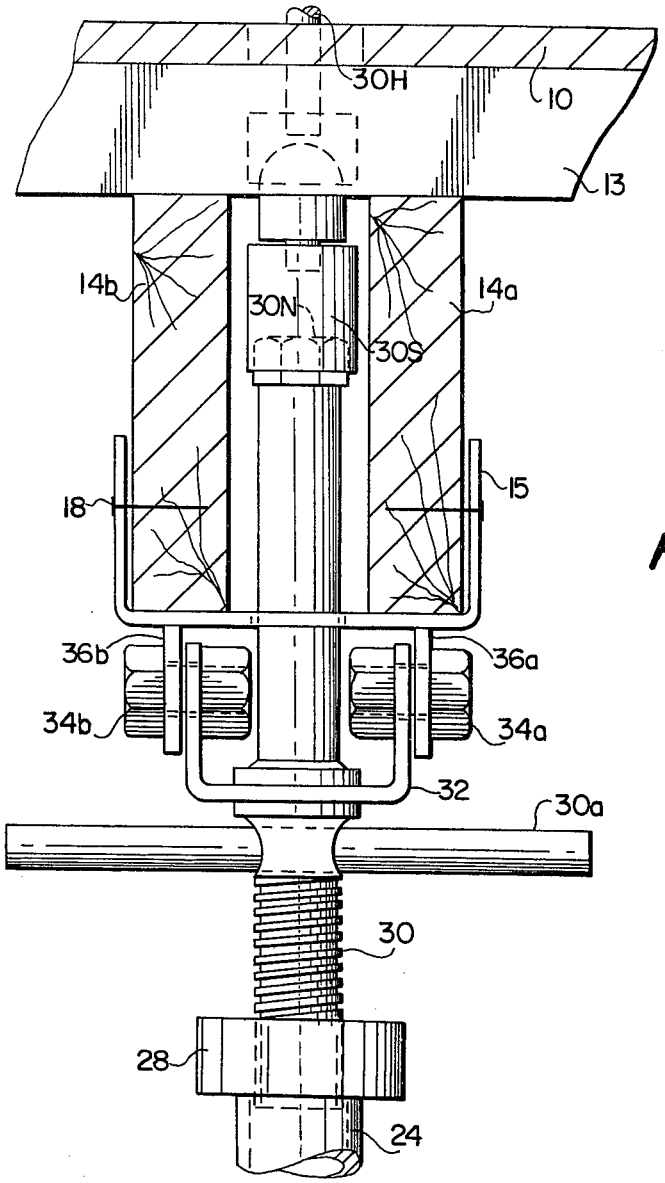
Figure 3:
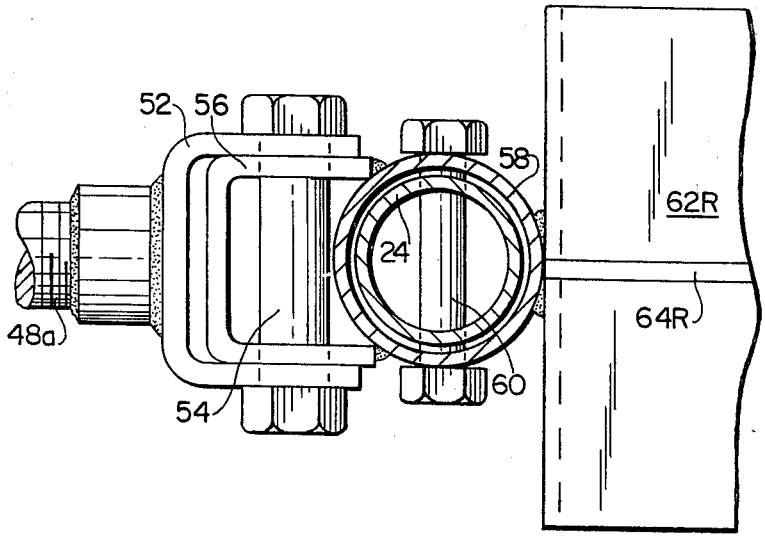

FIG. 3 is an enlarged sectional view taken on plane 3—3 of FIG. 2; and FIG. 4 is a sectional view taken on plane 4—4 of FIG. 1, which illustrates on an enlarged scale the aforementioned split or spaced-apart purlin feature of my invention and although such is not shown in FIG. 1, further illustrates also a wrench means extending through and operable from the upper side of the plywood decking in coupled relation to the means on the upper end of each vertical support rod which terminates in the space provided between said spaced-apart purlins.

Referring now to the drawing figures and more particularly to FIGS. 1 and 4, reference numeral 10 designates a preferably plywood deck or decking extending between two in-place, generally parallel, precast concrete girders 12R, 12L, on which a concrete roadway slab is to be laid. Illustratively, the plywood deck 10 is laid on and secured in place, as by nailing, to a plurality of spaced-apart joists 13 having length corresponding to roadway-slab width, said joists being in turn supported on spaced-apart purlins **14*a*, 14*b* (FIG. 4), which latter extend between said girders 12R, 12L at predetermined spaced intervals along the girder lengths, said spaced-apart purlins being disposed on edge in upright U-members 15, 16 and being secured thereto as by nails 18**. A more detailed description of said purlins and their function will appear hereinafter.

The aforesaid plywood deck 10, joists 13 and purlins 14*a*, 14*b*, taken together constitute the form or forming for a concrete slab to be laid on the plywood deck 10.

To support said form or forming, the invention provides at spaced intervals along the length of the girder pairs a plurality of vertically adjustable form-supporting assemblies 20R, 20L and at least one horizontally adjustable assembly generally designed 22H extending between each pair of vertically adjustable assemblies. Preferably, each said vertically adjustable assembly (20R and 20L) comprises a length of tubing 24 provided with holes 26 drilled at say two-inch centers lengthwise for a purpose which will be described. To the uppermost end of each said vertical tubing 24 is welded a nut 28 and extending through the threaded bore of said nut is a complementally threaded upright rod 30 which carries at a location near its upper end a cross handle 30*a* (which is better shown on FIG. 4) for turning said rod 30 when a preliminary or coarse adjustment of the length of the vertical assembly is desired or called for, as will be later explained. As also best seen in FIG. 4, such illustrating the right-end purlin supporting means, the upper end of said handle-turnable rod 30 is swivelly connected to an upright U-fixture 32 and attached thereto by bolts 34*a*, 34*b* are legs 36*a*, 36*b* affixed to and which depend from the horizontal bight portion of aforesaid purlin-receiving upright U-member 15.

It is to be understood, of course, that an identical upright supporting assembly 20L provides for the support and reception of the other end of the split purlins 14*a*, 14*b* via the aforesaid upright U-member 16 bolted to its end.

Each of the aforementioned horizontal assemblies 22H preferably comprises two telescopically related tubes or pipes 40, 42 drilled with holes preferably on 2 inch centers, through which are adapted to be passed one or more bolts 44 which secure tubes together as one, said holes on 2 inch centers providing for rough adjustment in the overall length of said horizontal assembly.

To the opposite ends of each horizontal assembly are welded nuts designated 46*a*, 46*b* and threaded through said nuts so as to extend lengthwise from the tubes are complementally threaded rods 48*a*, 48*b*, of which one is provided with right-hand threads and the other with left-hand threads, thus providing a "turnbuckle effect." That is to say when, the horizontal assembly 22H is turned on its axis in one direction, its length is increased, whereas when turned in the opposite direction its length decreases, such providing a means for fine adjustment in the overall length of said assembly 22H which supplements the aforesaid rough adjustment provided by the holes and bolts 44.

FIGS. 1 and 3, the latter on an enlarged scale, also illustrate a preferred form of connection between the right-end threaded rod 48*a* and the vertical supporting assembly 20R which is repeated in reverse on the other or left end of the horizontal assembly. More particularly, and as best seen in FIG. 3, said threaded rod is welded fast to an outwardly opening U-member or yoke 52 and fitted within and secured thereto as by a cross-bolt 54 is a smaller but longer U-member 56, to which is welded a length of pipe designated 58 whose inner diameter is such as to receive with sliding clearance the vertical-assembly pipe or tubing 24 and which is provided with holes for the reception of cross bolts 60 functioning to secure one end of the horizontal assembly 22H to the vertical assemply pipe at a predetermined height along the length of said vertical assembly pipe.

FIG. 1 also illustrates that said length of pipe 58 of the horizonal assembly has affixed thereto a triangularly shaped bracket 62R extending outwardly therefrom and whose hypotenuse side 64R corresponds to the inclined surface of the foot flange of the precast girder 12R. By providing the opposite end of said horizontal assembly 22H with a similar but left-hand triangular bracket 62L whose hypotenuse side is oppositely sloped from that of the bracket 62R, thus to correspond to the inclined surface of the bottom flange of the left-side precast girder 12L of the girder pair, and by turning the pipe or tubing of the horizontal assembly in direction as to extend the length of said assembly, said brackets 62R and 62L will press firmly against the oppositely inclined foot flanges of the girders, thereby effectively maintaining the vertically extending assemblies 20R and 20L in place and in position to support the forming and the concrete deck load.

Simple reversal i.e., upending, of the brackets 62R and 62L as disposes a horizontal edge of each in downwardly facing relation (as in FIG. 2) enables the same advantageous results to be obtained with steel girders of I-beam shape or configuration.

It is to be noted that in each of the FIGS. 1 and 2 embodiments, the horizontal assemblies 22H extending between the girder pairs are disposed at an elevation at which they are generally aligned with the facing lower flanges of the girder pairs. Thus, their end-mounted brackets 62R, 62L are capable of exerting force substantially directly against said girder flanges, rather than against higher elevation points or locations along the length of the vertical assemblies 20r, 20L, whereat if applied thereagainst, said force or forces would or could be in large measure dissipated.

FIG. 1 illustrates a useful auxiliary feature of the intention, namely that of affixing at a suitable elevation along a downwardly extended end of the vertical pipe of one (or of both) of the vertical assemblies and below the girders, a beam hanger or support 64 for a work-on/debris-catching platform 66.

Referring now to FIG. 4 and as forecast in an early part of this disclosure, said disposed-on-edge purlins 14*a*, 14*b* are spaced apart a distance such as provides for the ready accommodation of an extended length portion in which the upper end of handle-turnable rod 30 terminates. The upper end of said extended length portion has hex nut formation or has a separately formed hex nut 30N welded thereto.

Although physically separate from said nut 30N, the nut and thereby the rod 30 is adapted to be engaged and turned by a socket wrench (whose downwardly opening socket 30S is fitted to said nut 30N) and which is operable via an upwardly elongate wrench handle 30H of length such as to extend upwardly through a hole provided therefor in the decking 13 and being thus turnable by a workman on the upper side of i.e., a station disposed above, the decking.

The above novel arrangement provides for bodily adjustment in the height (elevation) of the plywood decking first by turning force applied to the cross handle 30*a* disposed below the decking, such being a conventional relatively coarse adjustment, and thereafter a final adjustment of decking elevation to an exact predetermined elevation, such after the reinforcing steel (if specifications call for same) has been placed and just prior to the pouring of the concrete which when hardened (cured) forms a roadway slab extending between the aforesaid girders.

To provide for passage of the wrench handle 30H and socket 30S through the plywood decking to and from the nut 30N on the upper end of the turnable rod 30, the plywood decking is drilled with a hole directly over and in line with the end of the vertical turnable rod 30, said hole being of a size to permit ready wrench-handle and socket insertion and removal. Upon the aforesaid final adjustment having been effected, said hole may be plugged by any suitable means.

While there are shown in the accompanying drawings preferred embodiments of the invention, it is to be understood that such are susceptible of modification and change without departing from the spirit of the invention as claimed.

I claim:

1. In concrete roadway slab-forming and form-elevation adjusting means, wherein said means comprises generally planar decking adapted to extend between and to be disposed flush with the top-most horizontal surfaces of a spaced-apart in-place pair of girders provided with oppositely facing foot flanges, a plurality of longitudinally extending, spaced-apart joists on which said decking is lair, purlins extending transversely between upper portions of said girders providing support for said joists and decking, said purlins being supported adjacent their ends in upwardly opening U-members, a pair of adjustable length generally vertical rodform support members supporting said U-members and adapted to extend between said facing foot flanges of the girders and said U-members, and adjustable means extending transversely between and supporting the lower end-length portions of said rod-form support members and adapted to be forcefully held to said oppositely facing foot flanges, the improvement comprising said purlins being disposed in laterally spaced-apart pairs in said U-members, and each said rod-form support member extending upwardly into the space between the pairs of purlins and terminating in means enabling bodily adjustment of the elevation of said purlins, joists and decking from above said decking.

2. In concrete roadway slab-forming and form-elevation adjusting means according to claim 1, wherein said transversely extending means includes foot-flange engaging brackets and wherein said brackets are invertible to provide when turned in one direction oppositely sloping surfaces and when inverted, surfaces which extend outwardly from and substantially at right angles to the axes of said vertical rod-form support.

3. In concrete roadway slab-forming and form-elevation means according to claim 1, wherein said rod-form vertical support members each incorporates means operable from beneath said U-members for effecting a coarse adjustment of the elevation of said decking, and said means on the upper ends of said vertical rod-form support members comprises a nut formation with which wrench means insertible through and operable from above said decking is adapted to be coupled to effect a final, predetermined adjustment of said decking elevation.

4. In concrete roadway slab-forming and form-elevation adjusting means the forms for concrete roadway according to claim 1, wherein said vertical rod-form members are extended downwardly past said transversely extending means, and mount hangers for a work-on debris-catching platform.

5. In concrete roadway slab-forming and form-elevation adjusting means the forms for concrete roadway according to claim 1, including wrench means operable from the upper side of said planar decking and adapted when cooperated with each said means on the upper ends rod-form of said vertical support members to effect an adjustment in the elevation of said planar decking.

6. In concrete roadway slab-forming and form-elevation adjusting means according to claim 1, wherein said vertical rod-form support members each incorporates means for effecting a first adjustment of the elevation of said decking from below the same, in combination with wrench means insertible and removable through said decking and being operable from above same and adapted when cooperated with the means provided on the upper end of each said vertical rod-form support member to effect a final adjustment in the elevation of said decking from above the same.

7. In concrete roadway slab-forming and form-elevation adjusting means according to Claim 6, wherein the means on the upper ends of each said vertical rod-form support member comprises a nut formation and wherein said wrench means operable through and from above the decking includes a turnable socket, fitted to said nut formation and being actuable by handle means extending upwardly therefrom through the decking.

* * * * *